US005666755A

United States Patent [19]

Longueira

[11] Patent Number: 5,666,755

[45] Date of Patent: Sep. 16, 1997

[54] METHOD AND APPARATUS FOR FAST DISASSEMBLY OF BLOWBACK AUTOLOADING PISTOL

[76] Inventor: Dino C. Longueira, 827 Richmond Rd., Staten Island, N.Y. 10304

[21] Appl. No.: 694,630

[22] Filed: Aug. 7, 1996

[51] Int. Cl.[6] ..... F41A 17/00

[52] U.S. Cl. ..... 42/75.02; 42/7; 42/48; 42/69.02

[58] Field of Search ..... 42/75.02, 7, 48, 42/69.02

[56] References Cited

U.S. PATENT DOCUMENTS

| | | | |
|---|---|---|---|
| 1,131,360 | 3/1915 | Fyrberg | 105/247 |
| 1,840,054 | 11/1932 | Reisina | 42/75.02 |
| 2,655,839 | 10/1953 | Ruger | 89/196 |
| 2,933,983 | 4/1960 | Ruger | 89/194 |
| 3,568,350 | 3/1971 | Silsby | 42/75 |
| 3,648,562 | 3/1972 | Loeble | 89/185 |
| 3,653,140 | 4/1972 | Alday | 42/16 |
| 3,979,849 | 9/1976 | Haskins | 42/76 R |
| 3,996,684 | 12/1976 | Bauman et al. | 42/16 |
| 4,066,000 | 1/1978 | Rostocil | 89/198 |
| 4,254,570 | 3/1981 | Uriarte del Rio | 42/2 |
| 4,664,015 | 5/1987 | Kennedy | 89/138 |
| 4,920,677 | 5/1990 | Schuerman | 42/16 |
| 5,195,226 | 3/1993 | Bornancini | 29/1.1 |
| 5,272,957 | 12/1993 | Chesnut | 89/195 |

*Primary Examiner*—Charles T. Jordan
*Assistant Examiner*—Meena Chelliah
*Attorney, Agent, or Firm*—Dennis M. Flaherty

[57] ABSTRACT

A method and a device for retrofitting existing autoloading pistols having a one-piece bolt stop pin. The first step of the retrofitting method is to cut off the original bolt stop pin and then machine a threaded bore in the remaining shaft. In addition, an extension which mimicks the original bolt stop pin configuration is manufactured. The extension has a threaded end which is screwed into the threaded bore in the remaining shaft portion of the original bolt stop pin. To disassemble a pistol having a two-piece bolt stop pin, the bolt stop pin extension is unthreaded from the remaining shaft portion using a screwdriver or similar implement. Then the loose extension is pulled upwards and out of the receiver, freeing the bolt to be pulled rearward and out of the receiver. The pistol is further modified by rounding the sharp upper corner of the hammer, e.g., by machining a smooth radius. As a result of this modification, when the leading edge of the reinserted bolt contacts the rounded upper corner, the hammer will be cammed downward and out of the way as the bolt is reinserted. When the bolt is fully inserted, the bolt stop pin extension can be screwed back into the remaining shaft portion of the original bolt stop pin, thus locking the bolt to the pistol.

13 Claims, 3 Drawing Sheets

METHOD AND APPARATUS FOR FAST DISASSEMBLY OF BLOWBACK AUTOLOADING PISTOL

FIELD OF THE INVENTION

This invention generally relates to autoloading pistols of the blowback type. In particular, the invention relates to blowback autoloading pistols in which a bolt stop pin is pivotably mounted to a hammer or main spring housing assembly.

BACKGROUND OF THE INVENTION

FIG. 1 shows a conventional blowback autoloading pistol. The pistol comprises three main parts: the grip or lower frame 2, the receiver 4 having a bore 6 and a breech 8, and a breech bolt assembly 10 which slides in the breech 8. The trigger guard 12 is integral with the lower frame 2. A hollow space in the lower frame 2 receives the magazine (not shown), the sear 14, the trigger assembly 16 and the hammer assembly 18. The rear of lower frame 2 has a recess for receiving the hammer or main spring housing assembly 20.

The hammer assembly 18 comprises a hammer 22 which is pivotably mounted to the lower frame 2 by means of a pivot pin 24. In addition, the hammer 22 is pivotably coupled to one end of a strut 26 by means of a pivot pin 28. The axes of the pivot pins 24 and 28 are mutually parallel and separated by a predetermined distance. The other end of strut 26 projects into a recess extending from the endface of a plunger 30. The plunger 30 has is slidably arranged in a cylindrical recess of the main spring housing 32. The plunger 30 and main spring housing 32 are parts of the main spring housing assembly 20. The latter assembly further comprises a hammer spring or main spring 34, which is arranged in the cylindrical recess of the main spring housing 32. One end of main spring 34 is coupled to plunger 30 and the other end of main spring 34 is seated against an end face of the cylindrical recess of main spring housing 32.

The hammer 22 is shown in the cocked position in FIG. 1 and is held in that position by the sear 14. When the hammer is in the cocked position, the main spring 32 is in a compressed state. The sear 14 is pivotably mounted to the lower frame 2 by means of a pivot pin 38. The distal end of the sear 14 engages a notch in the hammer to hold the hammer in the cocked position. The sear 14 is operatively coupled to the trigger 40 by means of a trigger rod (not shown). The trigger 40 is pivotably mounted to the lower frame 2 by means of a pivot pin (not shown) and the trigger rod is pivotably coupled to the trigger by means of a pivot pin and a spring (not shown). The trigger, trigger assembly and associated pivot pins and springs comprise the trigger assembly 16. In response to pulling of the trigger 40, the trigger rod releases the sear 14 and a sear spring (not shown) urges the sear out of engagement with the hammer, freeing the hammer for rotation in response to urging of the main spring. The hammer passes through a slot (not shown) in receiver 4. At the end of the hammer's rotation, the hammer strikes a firing pin 42, shown in FIG. 2.

The firing pin 42 is slidably mounted in a slot in the bolt assembly 10. The slot runs parallel to the axis of the bore 6. The firing pin 42 has a slot 44 which is penetrated by a transverse pin 46 which is inserted crosswise through the body 50 of the bolt assembly 10. The impact of the hammer against the back end of the firing pin drives the firing pin 42 forward. The firing pin spring 48 maintains rearward pressure on the firing pin for safety. The impact of the front tip of the firing pin against a cartridge (not shown) in the bore 6 causes the cartridge to fire. Upon firing the bullet is projected down the bore.

The reaction force of the firing drives the bolt body 50 rearward. During this rearward displacement, the spent casing (not shown) is ejected. As best seen in FIG. 3, the bolt assembly 10 comprises a recoil spring guide 52 comprising a guide rod 54 having a forward portion which slides in a channel formed in the bolt body 50. The rear end of the guide rod 54 is connected to a recoil spring slide 56, which is also part of the recoil spring guide 52. The recoil spring slide 56 has a bearing surface 58 which conforms to the shape of a bolt stop pin 72, against which the recoil spring slide bears.

In accordance with the conventional design of a known autoloading pistol, bolt stop pin 72 is pivotably mounted to an upper portion of the main spring housing 32 by means of a pivot pin 76. The upper end of main spring housing 32 also has a lug 78 which couples with a notch (not shown) in the receiver 4 to hold the receiver and lower frame 2 together. The upper end of the bolt stop pin penetrates a hole 104 in the receiver.

The recoil spring slide also has a pair of guide surfaces 60 which ride on respective tracks 62 on opposing sides of a slot 64 formed in the bolt body 50, as the bolt body recoils in the rearward direction. The width of slot 64 is greater than the diameter of the bolt stop pin 72 to allow the bolt body to slide rearward relative to the bolt stop pin. During rearward displacement of the bolt body, bolt stop pin 72 blocks rearward displacement of the recoil spring slide 56.

The bolt assembly 10 further comprises a recoil spring 66 loosely mounted on the guide rod 54. The recoil spring provides resistance to the bolt body 50 during firing and returns the bolt body to its closed position after firing. One end of recoil spring 66 is connected to the recoil spring slide 56. The other end of recoil spring 66 is connected to the front tenon 68 of the recoil spring guide 52. The front tenon 68 is secured in a transverse recess 70 formed in the bolt body 50. During recoil of the bolt body 50, the front tenon 68 compresses the recoil spring 66 against the recoil spring slide 56. When the force exerted by the compressed recoil spring 66 exceeds the force of bolt recoil, the spring returns the bolt body 50 to its closed position. During the return stroke of the bolt body, the bolt body pushes the next cartridge into the bore. At the end of the return stroke, the bolt body 50 is stopped when contact surface 74 abuts the bolt stop pin 72.

The main spring housing assembly 20 further comprises a disassembly lever 80 which is pivotably mounted to the main spring housing 32 by means of a pivot pin 82. When the disassembly lever 80 is pulled out of the housing, the portion of the lever below the pivot pin 82 pushes the lower end of main spring housing 32 out of the recess in which it is nested in the lower frame 2. The main spring housing 32 can then be pivoted about the pivot pin 76, thereby disengaging the lug 78 from the notch in the receiver. Then the bolt stop pin 72 is pulled axially downward, out of the pistol. With the bolt stop pin 72 removed, the bolt assembly 10 can be slided rearward, out of the breech 8. Then the receiver can be separated from the lower frame. In this disassembled state, the pistol can be cleaned.

The above-described disassembly procedure is relatively complex and time-consuming. It also requires a great deal of manual dexterity on the part of the user. As a result, the process of stripping and cleaning pistols of the above-described type, especially for pistol owners who are not professional gunsmiths, is difficult to master. This has been true for the many years during which such pistols have been manufactured and sold. Thus, there has been a long-felt need among owners of autoloading pistols of this type for a solution to the problem of difficult disassembly.

SUMMARY OF THE INVENTION

The present invention is a device for simplifying the disassembly of blowback autoloading pistols of the type in which a bolt stop pin is mounted to a main spring housing assembly. This device is designed to be retrofitted or installed in such a pistol with no modifications to the pistol's grip frame or receiver, thereby avoiding complex and costly machining. The purpose of the device of the invention is to simplify the procedure for field stripping such autoloading pistols to facilitate cleaning.

In accordance with the present invention, the bolt stop pin has been redesigned to be a two-piece pin, the upper part of which is screwed into the lower part and can be easily removed from the top of the pistol receiver simply by unscrewing. The lower part of the bolt stop pin remains in the pistol, pivotably attached to the main spring housing, but has a length sufficiently short that the lower pin part does not interfere with removal of the bolt from the receiver. Thus, the bolt can be removed without the necessity of removing the main spring housing assembly from the grip frame, thereby greatly simplifying disassembly.

The present invention encompasses a method for retrofitting existing autoloading pistols having a one-piece bolt stop pin. The first step of the retrofitting method is to cut off the original bolt stop pin and then bore out the remaining shaft. Next the bore of the remaining shaft must be threaded. In addition, an extension which mimicks the original bolt stop pin configuration must be manufactured. Preferably, the extension is fashioned using high-strength drill rod steel. The extension is then turned on a lathe to the proper diameter to mate with the remaining lower shaft portion. Then one end of the steel rod is reduced in diameter and threaded. After the threading operation, the extension must be trimmed to the appropriate length, which was determined to be approximately 3/16 inch longer than the length of the original bolt stop pin to allow the user enough grasp to remove the extension from the top of the receiver after the extension has been unthreaded from the lower shaft portion.

In order to disassemble a pistol incorporating the present invention, the bolt stop pin extension is unthreaded from the remaining shaft portion using a screwdriver or similar implement. Then the top of the loose extension is grasped and the extension can be pulled upwards and out of the receiver. Once the extension has been removed, the bolt can be pulled rearward and out of the receiver.

To replace the bolt in the receiver, a further modification of the pistol was required. If a conventional autoloading pistol of the type described in the Background of the Invention section is modified to incorporate the two-piece bolt stop pin of the invention, insertion of the bolt back into the receiver is blocked by a sharp upper corner of the hammer, which penetrates a slot in the receiver and projects into the path of the incoming bolt, thus blocking return of the bolt. In accordance with the present invention, this problem is obviated by rounding the sharp upper corner of the hammer, e.g., by machining a smooth radius along the upper corner. As a result of this modification, when the leading edge of the incoming bolt contacts the rounded upper corner, the hammer will be cammed downward and out of the way as the bolt is inserted. Thus, rounding of the upper corner of the hammer allows the bolt to return to its original position within the receiver. When the bolt is fully inserted, the bolt stop pin extension can be inserted through the receiver and bolt and threadably coupled to the remaining shaft portion of the original bolt stop pin using a screwdriver or similar implement. When the bolt stop pin extension is tightly screwed into the remaining shaft portion, the pistol is completely reassembled and ready for use.

DETAILED DESCRIPTION OF THE PREFERRED EMBODIMENT

Figure 4:
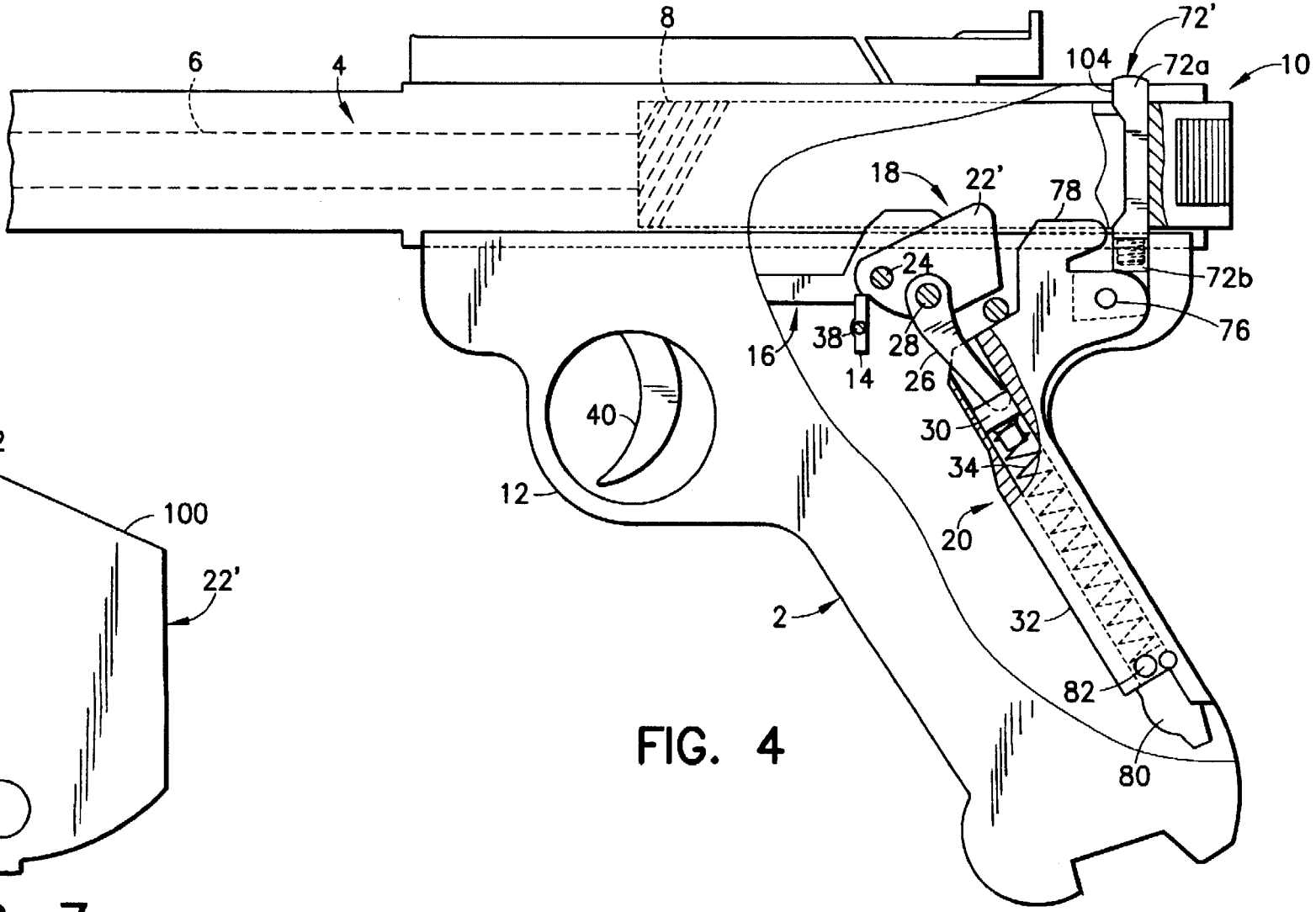
FIG. 4 is a schematic diagram showing a blowback autoloading pistol which has been retrofitted in accordance with the method of the present invention.

Referring to FIG. 4, a modified blowback autoloading pistol in accordance with the preferred embodiment of the invention comprises a modified hammer 22' and a modified bolt stop pin 72'. The bolt stop pin has been redesigned to be a two-piece pin, the upper pin part **72*a* of which is screwed into the lower pin part 72*b* and can be easily removed from the top of the pistol receiver 4 by unscrewing. The lower pin part 72*b* of the bolt stop pin remains in the pistol, pivotably attached to the main spring housing 32 by means of a pivot pin 76. As seen in FIG. 4, lower pin part 72*b* is sufficiently short that it does not interfere with removal of the bolt assembly 10 from the receiver 4. Thus, the bolt assembly 10 can be removed from the pistol without first removing the main spring housing assembly 20 from the grip frame 2**.

The upper and lower pin parts **72*a* and 72*b*** can be original parts incorporated in the pistol by the pistol manufacturer. Alternatively, a pistol having a one-piece bolt stop pin can be retrofitted with the present invention.

Figure 1:
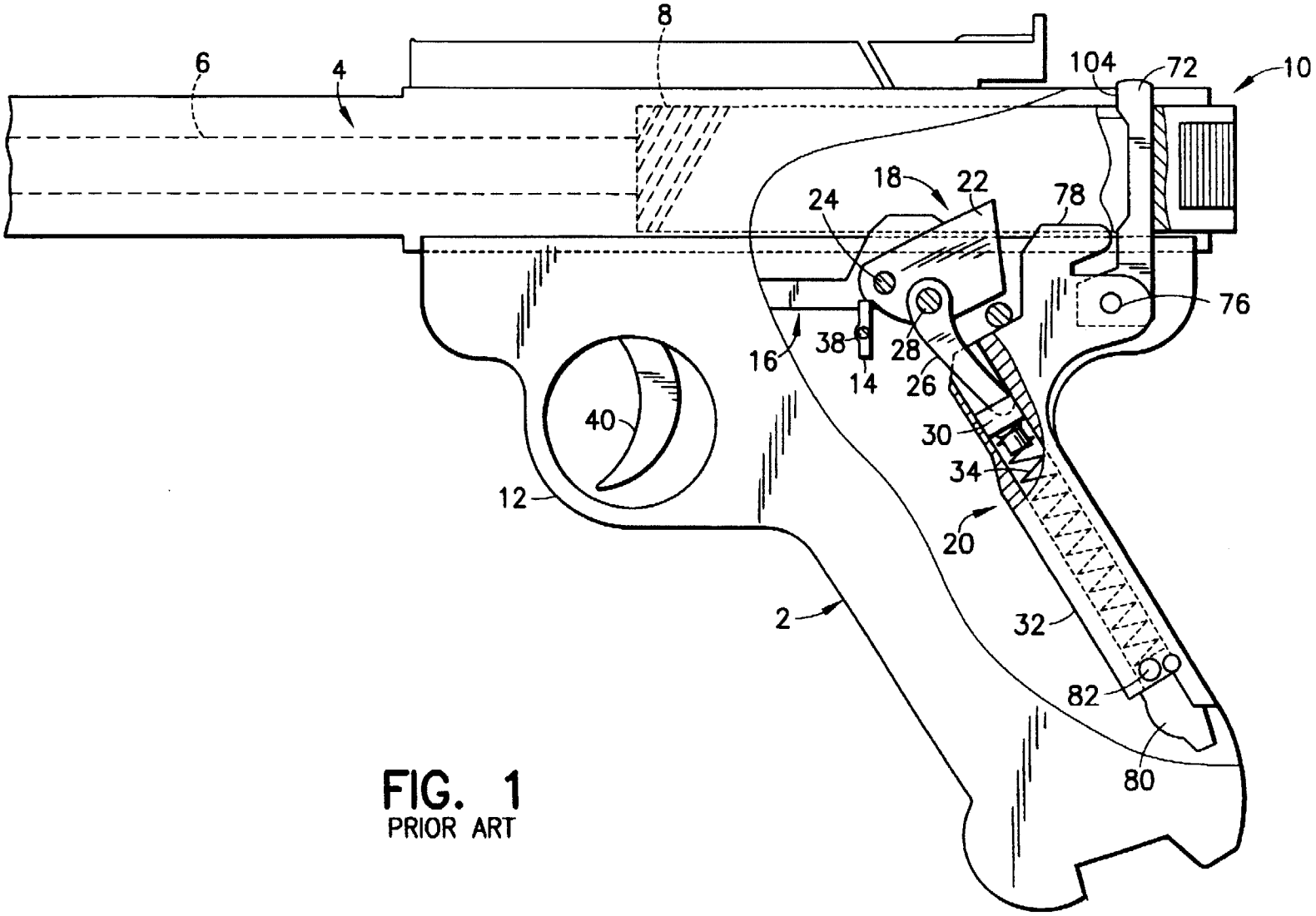
FIG. 1 PRIOR ART
FIG. 1 is a schematic diagram showing a conventional blowback autoloading pistol of the type in which a bolt stop pin is pivotably mounted to a hammer or main spring housing assembly.
Figure 2:
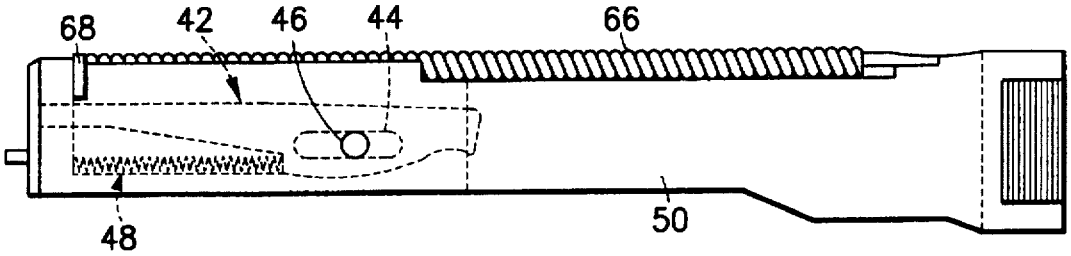
FIG. 2 PRIOR ART
FIG. 2 is a schematic diagram showing a side view of the bolt assembly incorporated in the pistol depicted in FIG. 1.
Figure 3:
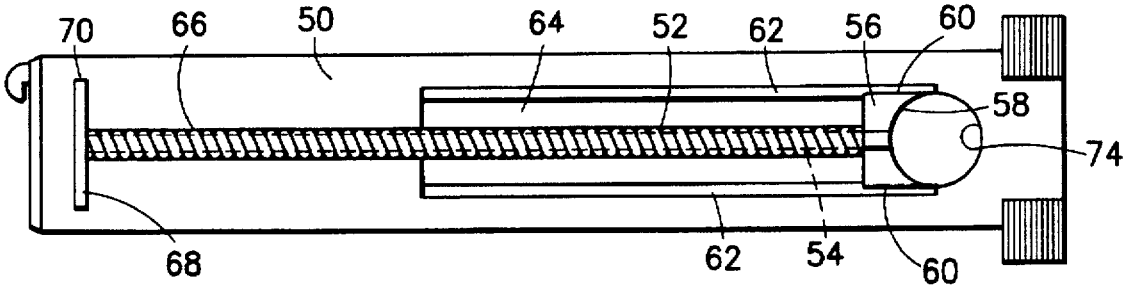
FIG. 3 PRIOR ART
FIG. 3 is a schematic diagram showing a top view of the bolt assembly depicted in FIG. 2.
Figure 5:
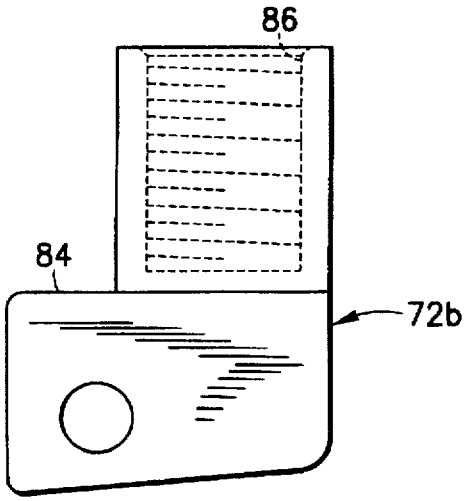
FIG. 5 is a schematic diagram showing a side view of a bolt stop pin which has been modified in accordance with the preferred embodiment of the invention.

The first step of the retrofitting method is to cut off the original bolt stop pin and face off the end to 0.25 inch from the lower edge 84, as shown in FIG. 5. Then the remaining shaft body is drilled to obtain 75% thread contact. The shaft body is drilled to a depth of 0.2±0.010 inch. The resulting bore 86 has a diameter of 0.213 inch. (The outer diameter of the original bolt stop pin shaft is 0.306±0.002 inch.) The bore is then tapped with ¼×28 NF threads: one cut with a plug tap and one cut with a bottoming tap. Finally, the opening at the top of the bore 86 is beveled with a 60° counterbore.

Figure 6:
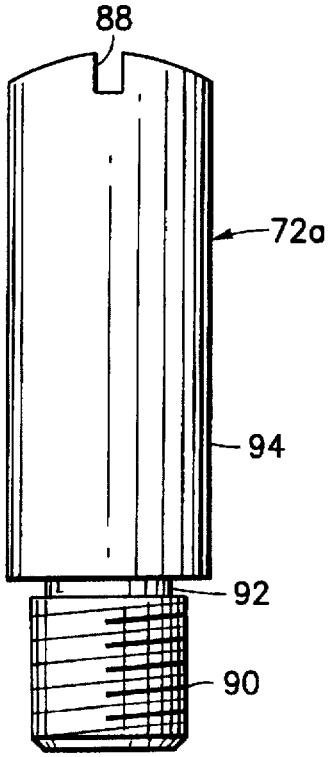
FIG. 6 is a schematic diagram showing a side view of a bolt stop pin extension in accordance with the preferred embodiment of the invention.

The second step of the method in accordance with the present invention is to manufacture an upper pin part or extension **72*a* which mimicks the original bolt stop pin configuration. This part can be made from high-strength drill rod steel. The steel rod is turned on a lathe to a diameter, i.e., 0.306±0.002 inch, to mate with the remaining lower shaft portion of the original bolt stop pin. One end of the steel rod is then radiused and then machined to form a transverse slot 88 having dimensions suitable for coupling with the distal end of a screwdriver, e.g., slot 88 has a depth of 0.10±0.015 inch and a width of 0.040±0.005 inch. The other end of the steel rod is then reduced in diameter, i.e., to 0.250±0.002 inch, by turning on a lathe, as seen in FIG. 6. The distal end of the reduced-diameter portion 90 is then beveled to 45° and a relief 92 having a depth of 0.020 inch and a width of 0.050 inch is then cut in the reduced-diameter portion adjacent the larger-diameter portion 94. The reduced-diameter portion 90 is then threaded to match the threads in bore 86 of the lower pin part 72*b*, i.e., ¼×28 NF threads. After the threading operation, the upper pin part 72*a*** must be trimmed to the appropriate length, which was determined to be approximately 3/16 inch longer than the length of the original bolt stop pin, i.e., 1.125±0.020 inch.

In order to disassemble a pistol incorporating the present invention, the user must first cock the pistol by pulling the bolt all the way to the rear. Then the magazine is removed and the bolt is returned to the closed position. At this point, the safety is engaged and care must be taken to not dry fire the pistol. Then using a screwdriver or similar implement, the upper pin part **72*a* is unthreaded from the lower pin part 72*b*. Then the top of the loose upper pin part 72*a* is grasped and pulled upwards and out of the receiver 4. With the upper pin part removed, the bolt assembly 10 is no longer blocked from being pulled rearward and out of the receiver 4**.

Figure 7:
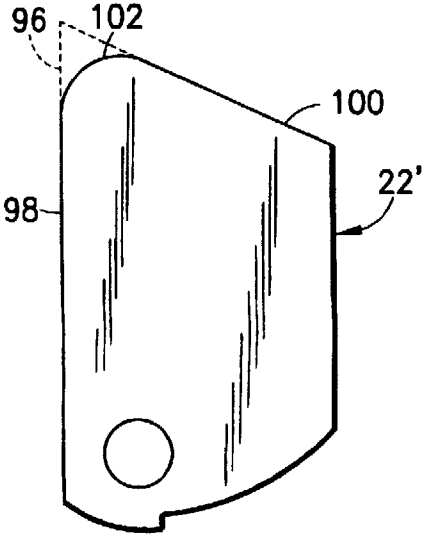
FIG. 7 is a schematic diagram showing a side view of a modified hammer in accordance with the preferred embodiment of the invention. The unmodified hammer is indicated by dashed lines.

To replace the bolt assembly in the receiver, a further modification of the pistol is required. If a conventional autoloading pistol is modified to incorporate the two-piece bolt stop pin of the invention, insertion of the bolt assembly 10 back into the receiver 4 is blocked by a sharp upper corner 96 (indicated by dashed lines in FIG. 7) of the hammer 22', which penetrates a slot in the receiver 4 and projects into the path of the reinserted bolt assembly 10, thus blocking full insertion of the bolt assembly. In accordance with the present invention, this problem is obviated by machining the sharp upper corner 96 to form a rounded upper corner 96', as indicated by the solid curve in FIG. 7. This is accomplished by machining a smooth radius along the upper corner. In the case of a specific pistol model of the type to which this invention applies, namely, the Ruger MKII pistol, the hammer has the sharp-cornered configuration depicted in FIG. 7. In this particular case, the upper corner is rounded by marking approximately 0.85 inch from the bottom of the front surface 98 and approximately 0.45 inch from the rear edge of the upper surface 100, and then radiusing between these two points. The rounded upper corner 102 is then finished and polished. As a result of this modification, when the leading edge of the incoming bolt assembly 10 contacts the rounded upper corner 102, the hammer 22' will be cammed downward and out of the way as the bolt assembly is inserted. Thus, rounding of the upper corner of the hammer allows the bolt assembly 10 to return to its original position within the receiver 4.

When the bolt assembly is fully inserted, the upper pin part **72*a* (see FIG. 6) can be inserted through the receiver 4 and bolt body 10, and then threadably coupled to the lower pin part 72*b* (see FIG. 5) using a screwdriver or similar implement. When the upper pin part 72*a* is tightly screwed into the lower part pin 72*b* (as shown in FIG. 4**), the pistol is completely reassembled and ready for use.

The preferred embodiment of the invention has been disclosed in connection with the retrofitting of a preexisting autoloading pistol. However, it will be apparent to those skilled in the art of gunsmithing that the invention may be incorporated in new pistols as original features. Thus, the present invention in its broadest scope encompasses any autoloading pistol having a two-piece bolt stop pin, irrespective of when the latter feature was incorporated in the pistol, i.e., whether originally or by retrofitting. In addition, variations and modifications of the disclosed preferred embodiment will be readily apparent to persons skilled in the art. All such variations and modifications are intended to be encompassed by the claims appended hereto.

I claim:

1. In a pistol comprising:

a grip frame having a recess;

a receiver mounted on said grip frame and having a breech and a hold communicating with said breech;

a bolt assembly received in said breech of said receiver, said bolt assembly comprising a firing pin and a recoil spring guide assembly;

a hammer pivotably mounted to said grip frame, said hammer being configured to strike said firing pin when pivoted;

a main spring housing assembly arranged in said recess of said grip frame and comprising a housing having a channel, a main spring arranged in said channel and a plunger slidably arranged in said channel in contact with said main spring;

a strut pivotably coupled to said hammer; and a bolt stop pivotably mounted to said main spring housing, said recoil spring guide assembly being in abutment with said bolt stop, the improvement wherein said bolt stop comprises an upper pin part, a lower pin part and means for coupling said upper pin part to said lower pin part, said upper pin part penetrating said hole in said receiver and said lower pin part being pivotably mounted to said main spring housing and having a height which does not interfere with removal of said bolt assembly from said receiver when said upper pin part is uncoupled from said lower pin part and removed from said receiver.

2. The pistol as defined in claim 1, wherein said coupling means comprise a threaded bore formed in one of said upper and lower pin parts, and a threaded portion formed on the other of said upper and lower pin parts, wherein said threaded portion threadably engages said threaded bore when said upper pin part is coupled to said lower pin part.

3. The pistol as defined in claim 1, wherein said upper pin part has a length such that a distal end thereof protrudes above said receiver.

4. The pistol as defined in claim 3, wherein said distal end of said upper pin part has a transverse slot.

5. The pistol as defined in claim 1, wherein said hammer has a rounded upper corner.

6. A method for retrofitting a pistol having a bolt stop pin pivotably mounted to a main spring housing and a hammer driven by a main spring housed in said main spring housing, comprising the steps of:

cutting off an upper portion of said bolt stop pin;

machining an axial threaded hole in a remaining lower portion of said bolt stop pin;

fabricating an extension having a threaded end which can threadably couple with said axial threaded hole in said remaining lower portion of said bolt stop pin; and screwing said threaded end of said extension into said axial threaded hole.

7. The method as defined in claim 6, further comprising the step of machining a transverse slot in an end of said extension remote from said threaded end.

8. The method as defined in claim 6, further comprising the step of rounding an upper corner of said hammer.

9. A pistol comprising:

a grip frame having a recess;

a receiver mounted on said grip frame;

a bolt assembly received in said receiver and comprising a firing pin and a recoil spring;

a hammer pivotably mounted to said grip frame and configured to strike said firing pin when pivoted;

a main spring housing arranged in said recess of said grip frame and having a channel;

a hammer spring arranged in said channel of said main spring housing;

means for coupling said hammer spring to said hammer; and a bolt stop pivotably mounted to said main spring housing, said recoil spring being arranged to urge said bolt assembly forward and away from said bolt stop, the improvement wherein said bolt stop comprises an upper pin part, a lower pin part and means for coupling said upper pin part to said lower pin part, said upper pin part penetrating said receiver and said lower pin part being pivotably mounted to said main spring housing and having a height which does not interfere with removal of said bolt assembly from said receiver when said upper pin part is uncoupled from said lower pin part and removed from said receiver.

10. The pistol as defined in claim 9, wherein said coupling means comprise a threaded bore formed in one of said upper and lower pin parts, and a threaded portion formed on the other of said upper and lower pin parts, wherein said threaded portion threadably engages said threaded bore when said upper pin part is coupled to said lower pin part.

11. The pistol as defined in claim 9, wherein said upper pin part has a length such that a distal end thereof protrudes above said receiver.

12. The pistol as defined in claim 11, wherein said distal end of said upper pin part has a transverse slot.

13. The pistol as defined in claim 9, wherein said hammer has a rounded upper corner.

* * * * *